US006182338B1

(12) United States Patent
Watanabe

(10) Patent No.: US 6,182,338 B1
(45) Date of Patent: Feb. 6, 2001

(54) FEMALE-MALE ENGAGING DEVICE WITH TAPES

(75) Inventor: Hirokazu Watanabe, Toyama-ken (JP)

(73) Assignee: YKK Corporation, Tokyo (JP)

( * ) Notice: Under 35 U.S.C. 154(b), the term of this patent shall be extended for 0 days.

(21) Appl. No.: 09/237,276

(22) Filed: Jan. 25, 1999

(30) Foreign Application Priority Data

Jan. 30, 1998 (JP) ..... 10-019041

(51) Int. Cl.[7] ..... A44B 13/00; A44B 11/25

(52) U.S. Cl. ..... 24/697.1; 24/399; 24/662; 24/698.1

(58) Field of Search ..... 24/697.1, 698.1, 24/662, 324, 399, 400, 318; 2/73, 248

(56) References Cited

U.S. PATENT DOCUMENTS

| | | | | |
|---|---|---|---|---|
| 1,253,521 | * | 1/1918 | Ozanne | 24/697.1 |
| 2,709,290 | * | 5/1955 | Rosenthal | 24/697.1 |
| 3,734,551 | * | 5/1973 | Hughes et al. | 24/662 |
| 3,751,770 | | 8/1973 | Italiano . | |
| 4,689,861 | * | 9/1987 | Kopelowicz | 24/662 |
| 5,293,672 | * | 3/1994 | Tominaga et al. | 24/400 |
| 5,380,238 | * | 1/1995 | Crew-Gee | 2/73 |

FOREIGN PATENT DOCUMENTS

| | | | |
|---|---|---|---|
| 1 960 185 | | 7/1970 | (DE) . |
| 985454 | | 3/1965 | (GB) . |
| 0422649 | * | 7/1948 | (IT) ..... 24/400 |
| 0581864 | * | 9/1958 | (IT) ..... 24/400 |
| 5 56806 | | 3/1993 | (JP) . |

* cited by examiner

*Primary Examiner*—Victor N. Sakran
(74) *Attorney, Agent, or Firm*—Finnegan, Henderson, Farabow, Garrett & Dunner, L.L.P.

(57) ABSTRACT

This invention provides a female-male engaging device with tapes having a flat shape and a good appearance, wherein a female engaging device and a male engaging device can be easily engaged and disengaged with each other. The female engaging device and the male engaging device are mounted to a side edge of a tape at intervals, the female engaging device is defined with a leg portion for sandwiching the edge portion of the tape, a cavity portion in front face of the leg portion, and a laterally long engaging hole in a front wall, and the male engaging device is defined with a leg portion for sandwiching the edge portion of the tape, a neck portion at a front face of the leg portion having a size substantially corresponding to that of the engaging hole, and a bulging engaging head at a front face of the neck portion having a constant width and a front face in a shape of a Rugby ball, a thickness of a center portion of the engaging head is larger than that of the engaging hole, and a thickness of each of opposite ends of the engaging head is smaller than that of the engaging hole. The engaging head is inserted from its opposite ends and engaged with the engaging hole, and the engaging head is disengaged from the engaging hole by pulling an end portion side. Because the engaging and disengaging operations are only in a plane direction, the operations are easy.

16 Claims, 9 Drawing Sheets

FEMALE-MALE ENGAGING DEVICE WITH TAPES

BACKGROUND OF THE INVENTION

1. Field of the Invention

This invention relates to a female-male engaging device with tapes used for foundation garments and inner wares such as brassieres and body suits, outerwear's such as sport wares, baby wares, and overalls for infant wares.

2. Description of the Related Art

As a conventional female-male engaging device with tapes of this type used for foundation garments, inner wares, outerwear's, baby wares, and overalls for infant wares, there is female and male engaging tapes as disclosed in Japanese Utility Model Laid-open publication Sho. No. 62-79416, wherein core strings are inserted in edge portions of a pair of tapes made of cloth which are folded into two in a longitudinal direction, female engaging devices each comprises a fitting hole at the edge of a first half portion and an attachment portion for sandwiching the tape on a latter half portion which are integrally molded from a synthetic resin, the female engaging devices are mounted to the edge portion of one of the tapes at constant intervals to form a female engaging tape, male engaging devices each comprises a hook-shaped engaging portion at the edge of the other first half portion for hooking the fitting hole and an attachment portion for sandwiching the tape on a latter half portion which are integrally molded from a synthetic resin, and the male engaging devices are mounted to the edge portion of the other tape at constant intervals to form a male engaging tape, as shown in FIG. 16.

There is also engaging device with tapes as disclosed in Japanese Patent No. 2525301 comprising a male engaging member having a neck portion on an edge portion of one pair of tapes which projects to a side, and a bulging head is set perpendicular to the neck portion, and a female engaging member having a fitting groove into which the neck portion is fitted, the male engaging member and the female engaging member each being integrally molded from synthetic resin, and male engaging member, a fitting groove and the attachment portion are formed at the same height, as shown in FIG. 17.

The above-described female and male engaging tapes shown in FIG. 16, in order to hook the male engaging device mounted to the tape to the female engaging device mounted to the tape the other tape, it is necessary to draw the tapes toward each other and to push the engaging portion of the male engaging device downward into the engaging hole of the female engaging device to hook the engaging portion to the engaging hole. Because the engagement requires operations in two directions, the operation is extremely bothersome. In addition, the engaging portion of the male engaging device is thick than the female engaging device that the engaging portion of the male engaging device projects compared to the other portions when the male engaging device is hooked to the female engaging device, and that is not preferable when the tapes are used for clothes. Because of the engaging mechanism of the female and male engaging devices, the engaging portion of the male engaging device can not be made thin. Also, there is a problem that the engaging portion of the male engaging device may be deformed and disengaged when a strong pulling force is applied to the female and male engaging devices.

The engaging device with tapes shown in FIG. 17, in order to hook the male engaging member mounted to the tape with the female engaging member mounted to the tape, it is necessary to draw the tapes toward each other and insert and push the bulging head and the neck portion of the male engaging member from above into the fitting groove and a notch groove of the female engaging member. Because the engagement requires operations in two directions, the operation is extremely bothersome. In addition, because the upper surface of the fitting groove of the female engaging member is open, the female engaging member is easily deformed and cause the bulging head to be disengaged from the fitting groove when a strong pulling force is applied to the engaging device with tapes. Furthermore, because the engaging device with tapes made of synthetic resin are mounted to the tapes by only sandwiching the edge portion of the tape, the devices can not be firmly fixed to the tapes and a strong product can not be produced.

SUMMARY OF THE INVENTION

This invention has been accomplished with in view of the above problems, and objects of the invention are stated in first and second aspects, to provide a female-male engaging device with tapes, wherein the female engaging device and the male engaging device can be easily engaged with each other because an engaging function of the devices is activated by an engaging operation in only one flat direction. Also, because an engaging mechanism is simple in structure, the female-male engaging device with tapes can be easily produced. The female and male engaging devices are flat and also can be easily operated.

According to third and forth aspects of the invention, in addition to the objects of first and second aspects, to provide a female-male engaging device with tapes which is convenient for use and easy to store, by specifying an arrangement of the female and male engaging devices mounted to the tapes.

According to fifth, sixth and seventh aspects of the invention, in addition to the objects of first, third and fourth aspects, to provide a female-male engaging device with tapes, wherein the female and male engaging devices are formed into a laterally long and flat shape, and engaging and disengaging operations of the female and male engaging devices can be appropriately and smoothly carried out, and the devices can be reliably engaged with each other, by specifying a pattern of engagement.

According to an eighth aspect of the invention, in addition of the objects of second, third and fourth aspects, to provide a female-male engaging device with tapes, wherein engaging and disengaging operations of the female and male engaging devices can be appropriately and smoothly carried out, and the devices can be reliably engaged with each other, by specifying a pattern of engagement.

According to ninth and tenth aspects of the invention, in addition to the objects in any one of first to eighth aspects, to provide a female-male engaging device with tapes, wherein the female and male engaging devices made of thermoplastic resin are stable and do not peel or drop off, and can be firmly fixed to the knitted or woven tapes by integral molding.

According to an eleventh aspect of the invention, in addition to the objects in any one of first to tenth aspects of the invention, to provide a female-male engaging device with tapes, wherein the female and male engaging devices have the same thickness and the devices can be formed into a thin shape with a good appearance as a whole.

To achieve the above objects, according to a first aspect of the invention, there is provided a female-male engaging device with tapes wherein a female engaging device mounted to a side edge of one of a pair of tapes at intervals and a male engaging device mounted to a side edge of the other tape so as to face each other, the female engaging device is defined with a leg portion for sandwiching the side edge of the tape, a cavity portion vertically penetrating the female engaging device at the front face of the leg portion, and an engaging hole defined in a front wall at a front end of the cavity portion for communicating with the cavity portion, and the male engaging device is defined with a leg portion for sandwiching the side edge of the tape, and a bulging engaging head projecting from a front face of the leg portion for being fitted into the engaging hole of the female engaging device and engaged with the front wall, such that the female engaging device and the male engaging device can be pushed against each other in a plane direction for engaging and disengaging with each other.

According to a second aspect of the invention, there is provided a female-male engaging device with tapes wherein a female engaging device mounted to a side edge of one of a pair of tapes at intervals and a male engaging device mounted to a side edge of the other tape so as to face each other, the female engaging device is defined with a leg portion for sandwiching the side edge of the tape, two flat tongue portions disposed at upper and lower portions of a front face of the leg portion, a cavity portion in the center of the tongue portions, and engaging portions at front ends of the tongue portions, and the male engaging device is defined with a leg portion for sandwiching the side edge of the tape, and a bulging engaging head projecting from a front face of the leg portion to be engaged with the engaging portions of the female engaging device, such that the female engaging device and the male engaging device can be pushed against each other in a plane direction for engaging and disengaging with each other.

According to a third aspect of the invention, in addition to the structure of first and second aspects, there is provided a female-male engaging device with tapes, wherein a plurality of the female engaging devices are disposed at the side edge of one of the pair of the tapes at intervals and the male engaging devices are disposed at the side edge of the other of the tapes so as to face the female engaging devices.

According to a forth aspect of the invention, in addition to the structure of first and second aspects, there is provided a female-male engaging device with tapes, wherein the female engaging device and the male engaging device are alternately and successively disposed on the side edge of the tape at intervals such that the female engaging device faces the male engaging device.

According to a fifth aspect of the invention, in addition to the structure of first, third and fourth aspects, there is provided a female-male engaging device with tapes, wherein the engaging hole defined in the front wall of the female engaging device is formed into a laterally long rectangle, the bulging engaging head of the male engaging device is arc-shaped in plan view and is ellipse-shaped in a front view, a thickness of the center portion of the engaging head is larger than a thickness of the engaging hole defined in the front wall, a thickness of each of opposite ends of the engaging head is smaller than the thickness of the engaging hole, and a thin neck portion is formed between the leg portion and the engaging head.

According to a sixth aspect of the invention, in addition to the structure of first, third and fourth aspects, there is provided a female-male engaging device with tapes, wherein the engaging hole defined in the front wall of the female engaging device is formed into a laterally long rectangle, a recessed groove into which a front end of the engaging head of the male engaging device can be fitted is defined in an inner wall of the front face of the leg portion, the bulging engaging head of the male engaging device is arc-shaped in plan view and is ellipse-shaped in a front view, a thickness of the center portion of the engaging head is larger than a thickness of the engaging hole defined in the front wall, a thickness of each of opposite ends of the engaging head is smaller than the thickness of the engaging hole, and a thin neck portion is formed between the leg portion and the engaging head.

According to a seventh aspect of the invention, in addition to the structure of first, third and fourth aspects, there is provided a female-male engaging device, wherein the engaging hole defined in the front wall of the female engaging device is formed into a laterally long rectangle, a recessed groove has a plane bottom surface into which a front end of the engaging head of the male engaging device can be fitted is defined in an inner wall of the front face of the leg portion, the bulging engaging head of the male engaging device has a front end edge portion substantially in a shape of a straight line and an ellipse-shaped in a front view, a thickness of a center portion of the engaging head is larger than a thickness of the engaging hole of the female engaging device, a thickness of each of opposite ends of the engaging head is smaller than the thickness of the engaging hole, and a thin neck portion is formed between the leg portion and the engaging head.

According to an eighth aspect of the invention, in addition to the structure of second, third and fourth aspects, there is provided a female-male engaging device with tapes, wherein the flat tongue portions projecting from the front face of the leg portion of the female engaging device have thick base portions, the cavity portion defined in the tongue portions has a square shape, a thin neck portion is formed between the engaging head and the leg portion of the male engaging device, the engaging head is set perpendicular to the neck portion, a thickness of a center portion of the engaging head is larger than a vertical gap between the engaging portions of the female engaging device and a thickness of each of opposite ends of the engaging head is smaller than the gap between the engaging portions.

According to a ninth aspect of the invention, in addition to the structure in any one of first to eight aspects, there is provided a female-male engaging device with tapes, wherein the female engaging device and the male engaging device each made of thermoplastic resin, and each integrally molded at constant intervals by sandwiching a bulging core portion formed at the side edge of the tape knitted or woven by a synthetic fiber thread.

According to a tenth aspect of the invention, in addition to the structure in any one of first and eighth aspects, there is provided a female-male engaging device with tapes, wherein the female engaging device and the male engaging device each made of thermoplastic resin, and each integrally molded through a through hole formed at constant intervals at the side edge of the tape knitted or woven by a synthetic fiber thread.

According to an eleventh aspect of the invention, in addition to the structure of first to tenth aspects, there is provided a female-male engaging device with tapes, wherein the female engaging device and the male engaging device are each made of thermoplastic resin, have leg portions with the same thickness, and have entirely flat shapes in the same plane.

DESCRIPTION OF THE PREFERRED EMBODIMENTS

Figure 1:
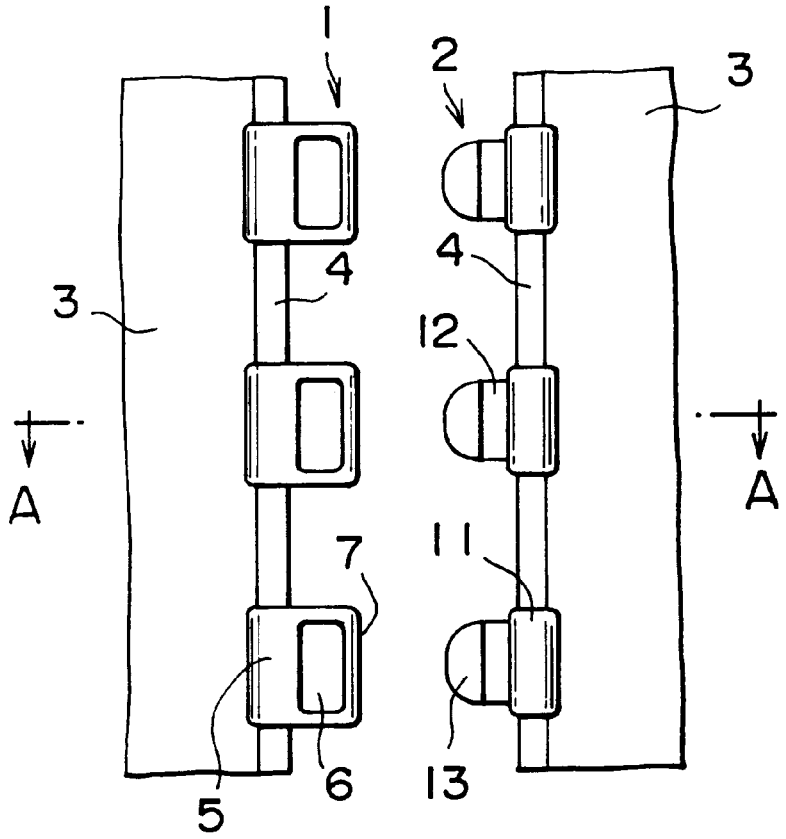
FIG. 1 is a plan view of an essential portion of a first embodiment of a female-male engaging device with tapes.

Embodiments of a female-male engaging device with tapes of this invention are specifically described by references to the drawings.

The female-male engaging device with tapes comprises female engaging devices 1 mounted to opposed edges of a pair of narrow tapes 3 and male engaging devices 2 mounted to another edge of the other tape, or comprise female engaging devices 1 and male engaging devices 2 alternately mounted at constant intervals to one side edge of a narrow tape 3. The tape 3 is formed by knitting or weaving synthetic fiber threads of polyamide series, polyester series, and the like. A bulging core portion 4 is formed at an edge portion of the tape 3. The core portion 4 is integrally formed by knitting or weaving a core string into the tape or by sewing the core string on the tape with a sewing thread.

In any of the embodiments of the female-male engaging device with tapes, the female engaging device 1 and the male engaging device 2 are integrally molded and mounted at constant intervals to the core portions 4 formed on the opposed edge portions of the pair of tapes 3 or to the flat tapes 3 by injection molding processing means or by extrusion molding processing means using thermoplastic resin such as polyamide, polyacetal, polypropylene, and polybutyleneterephthalate.

Figure 2:
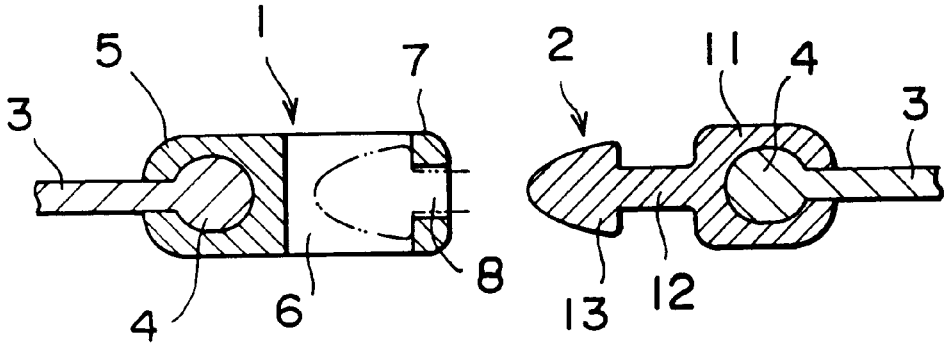
FIG. 2 is a sectional view of a first embodiment of a female-male engaging device with tapes taken along a line A—A.
Figure 3:
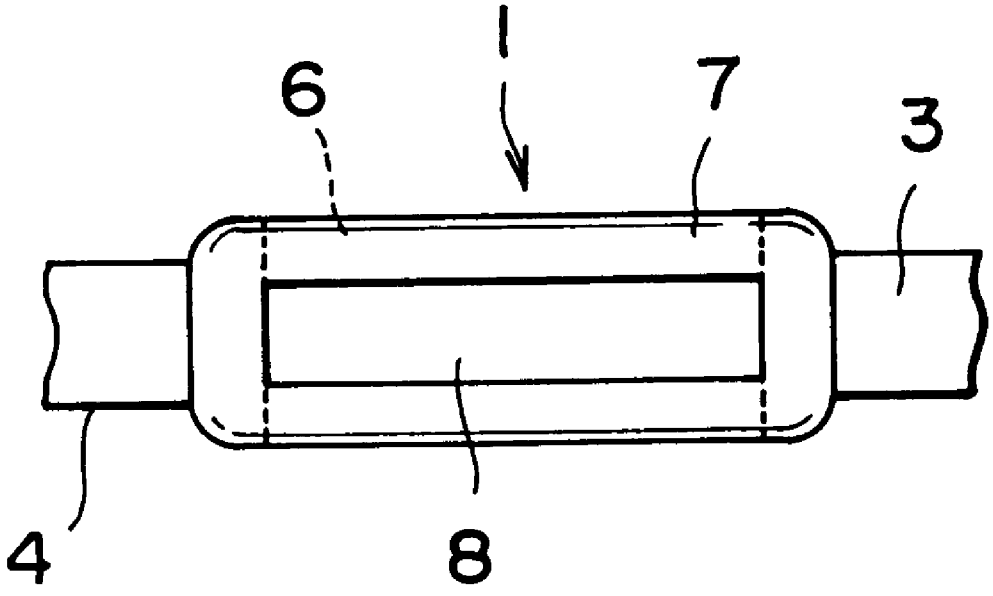
FIG. 3 is a front view of a first embodiment of a female engaging device of the female-male engaging device with tapes.

In a first embodiment of the female-male engaging device with tapes shown in FIGS. 1 to 4, each of the female engaging devices 1 is in a plane and flat square shape and comprises a leg portion 5 for sandwiching from above and below a core portion 4 formed on an edge portion of the tape 3 and a cavity portion 6 which is long in a longitudinal direction of the tape 3 and vertically penetrates a front face of the leg portion 5, as shown in FIGS. 1 and 2. As shown in FIG. 3, a front wall 7 at an end of the cavity portion 6 is defined with a rectangular engaging hole 8 which is long in the longitudinal direction of the tape such that the engaging hole 8 communicates with the cavity portion 6 and an engaging head 13 of each of the male engaging devices 2 can be inserted into and engaged with the engaging hole 8.

Figure 4:
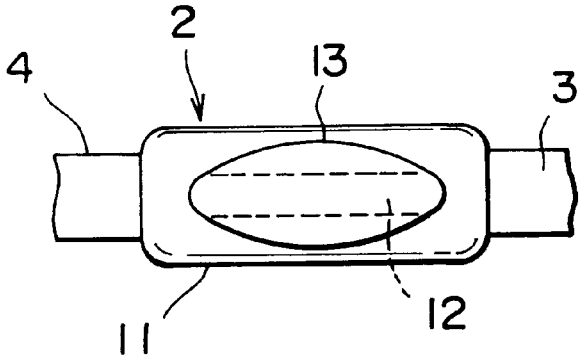
FIG. 4 is a front view of a first embodiment of a male engaging device of the female-male engaging device with tapes.

As shown in FIGS. 1 and 2, each the male engaging device 2 comprises a rectangular leg portion 11 for sandwiching a core portion 4 formed on an edge portion of the tape 3, a thin neck portion 12 projecting from a front face of the leg portion 11 and having a width smaller than that of the leg portion 11 and substantially equal to that of the engaging hole 8, and a bulging engaging head 13 which is mounted to an end of the neck portion 12, which is an arc-shaped having the same width as that of the neck portion 12 and having a plan shape enlarged at its center in a plan view, and which is triangular in cross section, such that the engaging head 13 can receive the front wall 7 of the female engaging device 1. The engaging head 13 is in a front view a shape of an ellipse or for example a rugby ball, as shown in FIG. 4. A thickness of the center of the engaging head 13 is larger than that of the engaging hole 8 defined in the female engaging device 1 and a thickness of opposite ends of the engaging head 13 is smaller than that of the engaging hole 8, such that the female engaging device 1 and the male engaging device 2 can be easily engaged and disengaged with each other. The plane shapes of the leg portions 5 and 11 can be other forms, thereby forming the female and male engaging devices with beautiful design.

Figure 5:
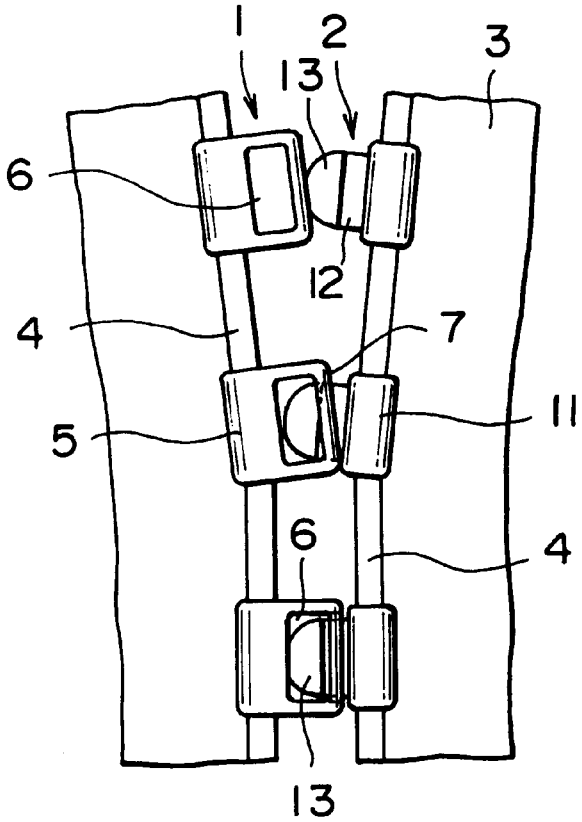
FIG. 5 is a plan view a first embodiment of showing a using condition of the female-male engaging device with tapes.

Engaging and disengaging operations of the female engaging device 1 and the male engaging device 2 of the above shapes is described as follows. As shown in FIG. 5, the engaging head 13 of the male engaging device 2 is drawn toward the engaging hole 8 in the front wall 7 of the female engaging device 1, the engaging head 13 is inserted into the engaging hole 8 from an end portion of the engaging head 13 having a smaller thickness than that of the engaging hole 8, and the female engaging device is pushed such that the thick center portion of the engaging head 13 is fitted into and engaged with the cavity portion 6.

In order to draw and disengage the male engaging device 2 out from the female engaging device 1, each end of the pair of tapes 3 are pulled left and right such that the tapes deflect from each other. In this manner, the thin end portion of the engaging head 13 can be easily disengaged from the cavity portion 6 of the female engaging device 1 through the engaging hole 8. By further strongly pulling the female engaging device 1 and the male engaging device 2 left and right, the thick center portion of the engaging head 13 can be drawn out and disengaged from the engaging hole 8.

The female-male engaging device with tapes of this shape is characterized in that the engaging he ad 13 of the male engaging device 2 is engaged with the front wall 7 of the female engaging device 1, by an operation of pushing and engaging the female engaging device 1 and the male engaging device 2 against each other in a plane direction.

Figure 6:
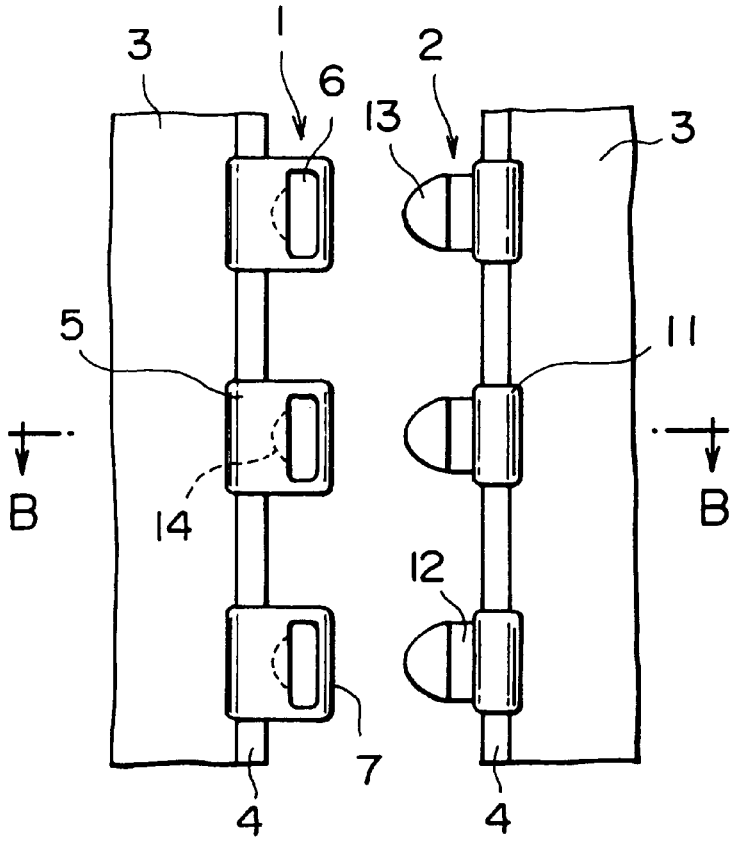
FIG. 6 is a plan view of an essential portion of a second embodiment of a female-male engaging device with tapes.
Figure 7:
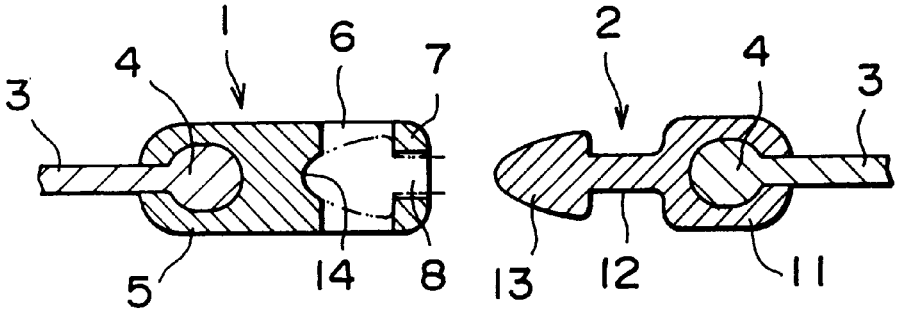
FIG. 7 is a sectional view of a second embodiment of a female-male engaging device with tapes taken along a line B—B.

A second embodiment of the female-male engaging device with tapes shown in FIGS. 6 and 7 is substantially the same as the first embodiment in the shape of the male engaging device 2. The shape of the male engaging device 2 of the second embodiment is same as that of the first embodiment except that a projecting amount of the engaging head 13 in the plane direction is slightly larger.

The female engaging device 1 of the second embodiment is different from that of the first embodiment in that a width of the cavity portion 6 defined in the front face of the leg portion 5 is smaller, and an arc-shaped recessed groove 14 substantially corresponding to the engaging head 13 is defined in the front face of the leg portion 5 in the cavity portion 6 such that the arc-shaped engaging head 13 of the male engaging device 2 can be fitted into the groove 14. The recessed groove 14 may have a plane bottom line. By providing the recessed groove 14, a tip end portion of the engaging head 13 is accommodated in the recessed groove 14 when the female engaging device 1 and the male engaging device 2 are engaged with each other, thereby easily prevents a vertical swinging and obtains a stable engagement.

Figure 8:
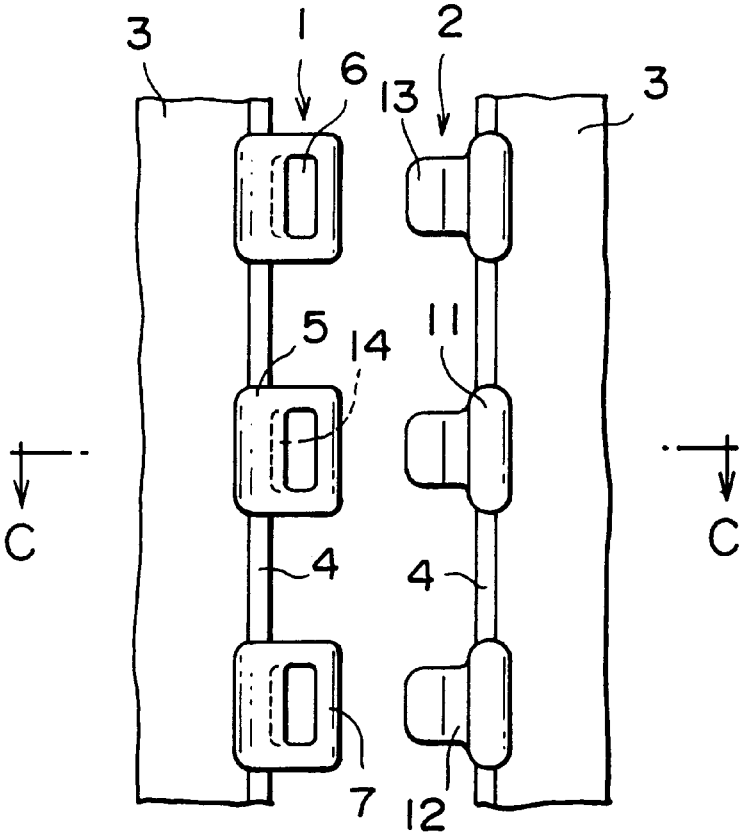
FIG. 8 is a plan view of an essential portion of a third embodiment of a female-male engaging device with tapes.
Figure 9:
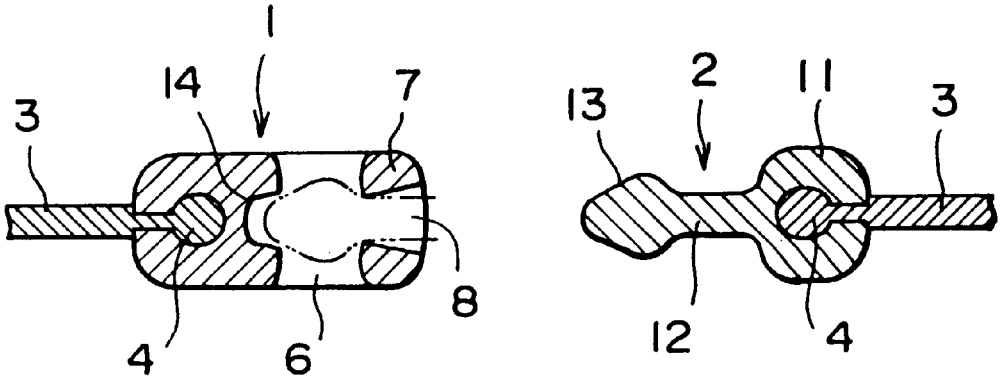
FIG. 9 is a sectional view of a third embodiment of a female-male engaging device with tapes taken along a line C—C.

A third embodiment of the female-male engaging device with tapes shown in FIGS. 8 and 9 has substantially the same shape as the above embodiments. However, in the female engaging device 1, a cavity portion 6 having a rectangular plane shape vertically penetrates the front face of the leg portion 5 which sandwiches the tape 3. A recessed groove 14 which has a plane bottom line is defined in an inner wall of the cavity portion 6 such that the groove 14 can receive the engaging head 13 which end portion in a shape of a straight line of the male engaging device 2. The engaging hole 8 defined in the front wall 7 tapers toward the cavity portion 6 so as to facilitate insertion of the engaging head 13 of the male engaging device 2.

The male engaging device 2 is formed with engaging head 13 which is in a cross-sectional view has a head of a snake shape. The engaging head 13 is formed at an end of the thin neck portion 12 having a rectangular plane shape in front of the leg portion 11 for sandwiching the tape 3, thereby facilitating engagement and disengagement of the male engaging device 2 with the female engaging device 1.

Figure 10:
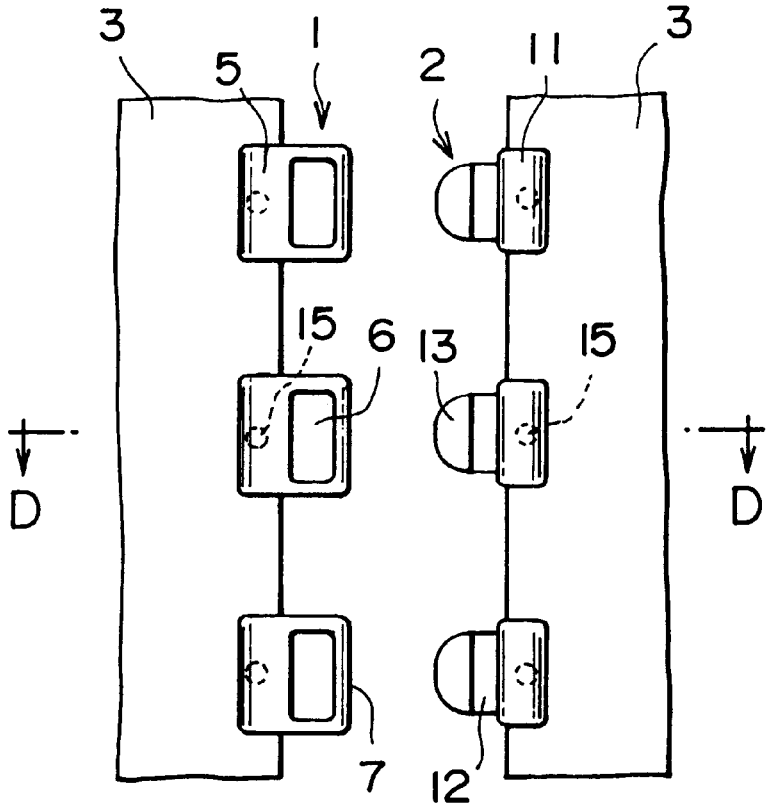
FIG. 10 is a plan view of an essential portion of a fourth embodiment of a female-male engaging device with tapes.
Figure 11:
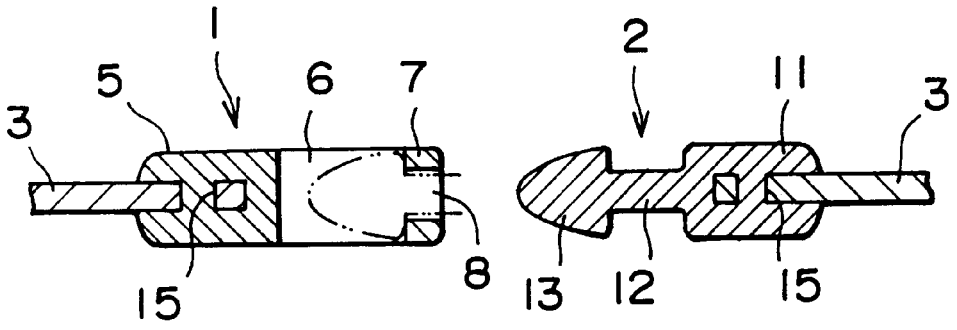
FIG. 11 is a sectional view of a fourth embodiment of a female-mal engaging device with tapes taken along a line D—D.

The female engaging device 1 and the male engaging device 2 of a fourth embodiment of the female-male engaging device with tapes shown in FIGS. 10 and 11 are the same in shape as those of the first embodiment. However, a shape of an edge portion of each the narrow tape 3 of the embodiment is different from that of the first embodiment. The edge portion of each the tape 3 is not defined with the bulging core portion but is flat. Instead, the edge portion of the tape 3 has through hole 15 which the female engaging devices 1 and the male engaging devices 2 are molded. By integrally molding the female engaging devices 1 and the male engaging devices 2 from thermoplastic resin with the leg portions 5 respectively penetrating the through holes 15, it is possible to firmly fix the female engaging devices 1 and the male engaging devices 2 to the tapes 3. It is also possible to apply the shapes of the female engaging devices 1 and the male engaging devices 2 of the above respective embodiments.

Figure 12:
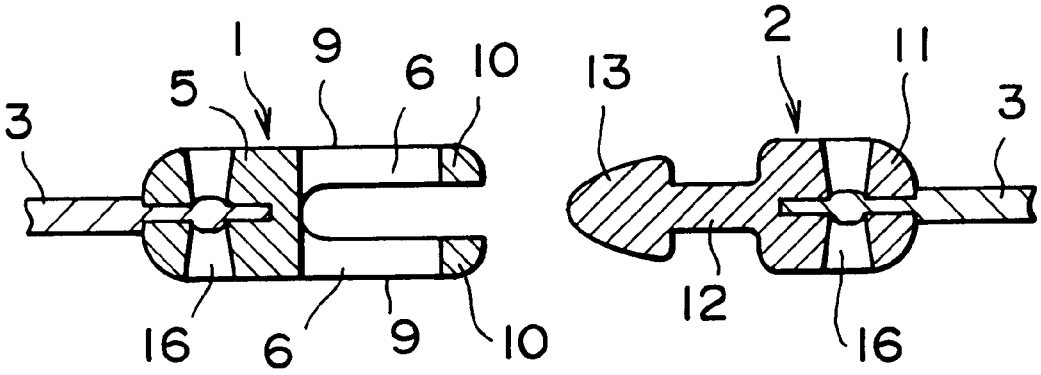
FIG. 12 is a cross sectional view of a fifth embodiment of a female-male engaging device with tapes.
Figure 13:
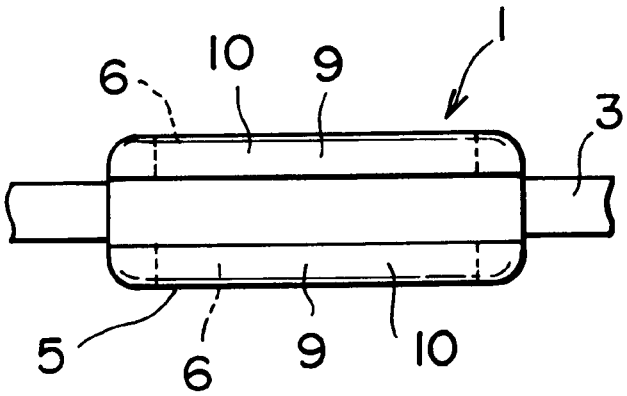
FIG. 13 is a front view of a fifth embodiment of a female engaging device of the female-male engaging device with tapes.
Figure 14:
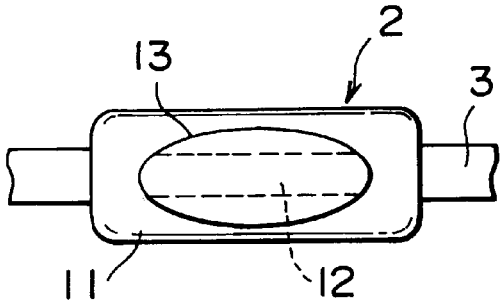
FIG. 14 is a front view of a fifth embodiment of a male engaging device of the female-male engaging device with tapes.

A fifth embodiment of the female-male engaging device with tapes shown in FIGS. 12 to 14 largely differs from the above embodiments in the shape of the female engaging device 1. Each the female engaging device 1 is molded from thermoplastic resin on a side edge of the flat narrow tape 3. Each of the female engaging device 1 is molded after holding and fixing the side edge of the tape 3 with a holding pin. The female engaging device 1 has flat tongue portions 9 project from upper and lower portions of the front face of the leg portion 5 which sandwich the tape 3, and a square cavity portion 6 is formed to vertically penetrate center portions of the tongue portions 9 so as to form engaging portions 10 at upper and lower portions of a front end of the female engaging device 1. In this manner, inside base portions of the tongue portions 9 are formed to be thick thereby reinforcing the inside base portions. A reference numeral 16 designates a pin hole.

The male engaging device 2 comprises a leg portion 11 molded for sandwiching the side edge of the tape 3, a thin neck portion 12 is projecting from the front face of the leg portion 11, and a bulging engaging head 13 which is formed is set perpendicular to a front end of the neck portion 12 and which is in a triangle in cross sectional view. As shown in FIG. 14, a front face of the engaging head portion 13 is formed into an ellipse-shape of a rugby ball shape. A thickness of a center portion of the engaging head 13 is larger than a vertical gap between the engaging portions 10 of the female engaging device 1, and a thickness of each of the opposite ends of the engaging head 13 is smaller than the vertical gap between the engaging portions 10, such that the male engaging device 2 can be easily engaged with or disengaged from the female engaging device 1, by drawing and pushing the male engaging device 2 toward and against the female engaging device 1 or by pulling the male engaging device 2 away from the female engaging device 1. The tip end of the engaging head 13 of the male engaging device 2 may be in an arc-shaped or straight-line in a plane view.

Figure 15:
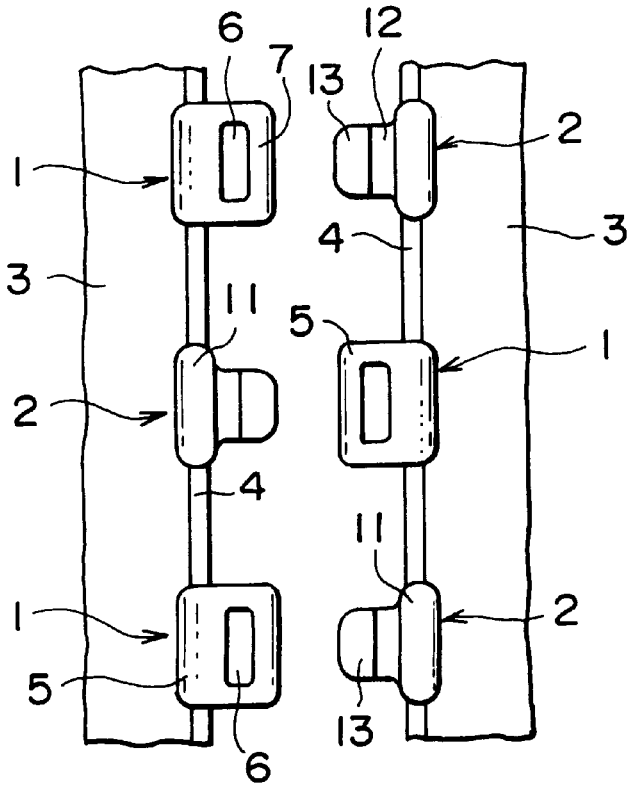
FIG. 15 is a plan view of an essential portion of a sixth embodiment of a female-male engaging device with tapes.
Figure 16:
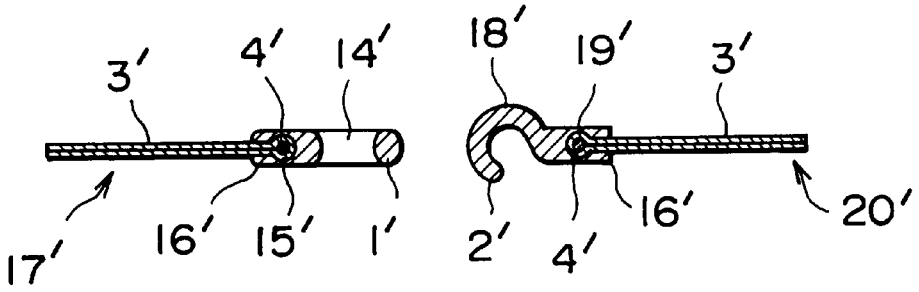
FIG. 16 is a cross sectional view of known female and male engaging tapes.
Figure 17:
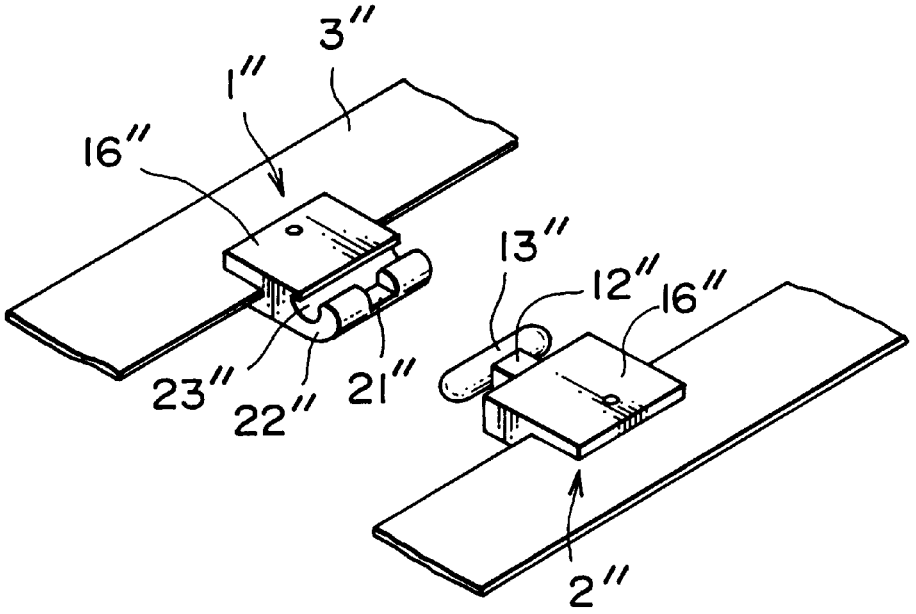
FIG. 17 is a perspective view of other known engaging devices with tapes.

In a sixth embodiment of the female-male engaging device with tapes shown in FIG. 15, the female engaging devices 1 and the male engaging devices 2 described in the above embodiments are alternately and integrally molded from thermoplastic resin and mounted to a side edge of the narrow tape 3 with intervals. A long tape 3 on which the female engaging devices 1 and the male engaging devices 2 are mounted is cut into tapes with an appropriate length, and a pair of cut tapes are set so as to each the female engaging device 1 faces each the male engaging device 2.

The female-male engaging device with tapes of this invention has the above-described structure, and has the following effects according to the structure.

According to a first aspect of the invention, a female engaging device mounted to a side edge of the tape at intervals faces a male engaging device mounted to a side edge of the other tape at intervals, the female engaging device is defined with a leg portion for sandwiching the tape, a cavity portion vertically penetrating the female engaging device in front of the leg portion, and an engaging hole at a front wall of a front end of the cavity portion for communicating with the cavity portion, and the male engaging device is defined with a leg portion for sandwiching the tape, and an engaging head at a front face of the leg portion to be inserted to the engaging hole and engaged at the front wall, such that the female engaging device and the male engaging device can be pushed against each other in a plane direction for engaging and disengaging with each other. Therefore, the female engaging device and the male engaging device can be pushed against each other in a plane direction for easy engagement with each other, and thus the engaging operation is easy. Because the engaging mechanism is a simple structure, production of the device is easy and the flat device with a good appearance can be obtained.

According to a second aspect of the invention, a female engaging device mounted to a side edge of a tape at intervals faces a male engaging device mounted to a side edge of the other at tape intervals, the female engaging device is defined with a leg portion for sandwiching the tape, two tongue portions disposed at upper and lower portions of a front face of the leg portion, a cavity portion in center portions of the tongue portions, and engaging portions at front ends of the tongue portions, and the male engaging device is defined with a leg portion for sandwiching the tape, and an engaging head at a front face of the leg portion to be engaged with the engaging portion, such that the female engaging device and the male engaging device can be pushed against each other in a plane direction for engaging and disengaging with each other. Thus the engaging operation is extremely easy. Even if an inserting position of the male engaging device into the female engaging device is slightly displaced from a normal position, the male engaging device easily guides to the normal position to be appropriately engaged with the female engaging device.

According to a third aspect of the invention, in addition to the effects of the invention stated in first and second aspects, a plurality of the female engaging devices are disposed at the side edge of one of a pair of the tapes at intervals and the male engaging devices are disposed at the side edge of the other of the tapes so as to face the female engaging devices. Therefore, production is easy and efficient.

According to a fourth aspect of the invention, in addition to the effects of the invention stated in first and second aspects, the female engaging device and the male engaging device are alternately and successively disposed on the side edge of the tape at intervals such that the female engaging device faces the male engaging device. Therefore, the female-male engaging device with tapes can be easily produced. Moreover, because the female-male engaging device with tapes is in a shape of a successive tape, storage is extremely easy, and the product can be easily supplied for use.

According to a fifth aspect of the invention, in addition to the effects of the invention stated in any one of first, third and fourth aspects, the engaging hole defined in the front wall of the female engaging device is formed into a laterally long rectangle, the bulging engaging head of the male engaging device is an arc-shaped in a plan view and is ellipse-shaped in a front view, a thickness of the center portion of the engaging head is larger than a thickness of the engaging hole, a thickness of each of opposite ends of the engaging head is smaller than the thickness of the engaging hole. Therefore, the male engaging device can be appropriately and smoothly engaged and disengaged with the female engaging device and engagement is stable.

According to a sixth aspect of the invention, in addition to the effects of any one of first, third and fourth aspects, a recessed groove into which a front end of the engaging head can be fitted is defined in an inner wall of the front face of the leg portion of the female engaging device. Therefore, when the female engaging device and the male engaging device are engaged, or to be engaged, the engaging operation and the engagement are stable.

According to a seventh aspect of the invention, in addition to the effects of any one of first, third and fourth aspects, the engaging hole defined in the front wall of the female engaging device is formed into a laterally long rectangle, a recessed groove has a plane bottom surface into which a front end of the engaging head can be fitted is defined in an inner wall of the front face of the leg portion, and the engaging head of the male engaging device has a front end substantially in a shape of a straight line. Therefore, when the female engaging device and the male engaging device are engaged with each other and engagement are stable.

According to an eighth aspect of the invention, in addition to the effects of any one of second, third and fourth aspects, the tongue portions projecting from the front face of the leg portion of the female engaging device have thick base portions, the cavity portion has a square shape, the engaging head of the male engaging device is set perpendicular to the neck portion, a thickness of a center portion of the engaging head is larger and a thickness of each of opposite ends of the engaging head is smaller. Therefore, the female and male engaging devices can be firmly engaged with each other. Moreover, even if the engaging position is slightly displaced, the male engaging device easily guides to the normal position, and the female and male engaging devices can be reliably engaged with each other even by a rough engaging operation.

According to ninth and tenth aspects of the invention, in addition to the effects of the invention stated in any one of first to eighth aspects, the female engaging device and the male engaging device are made of thermoplastic resin, and each mounted by sandwiching a bulging core portion formed at the side edge of the tape knitted or woven by using a synthetic fiber thread, or each mounted through a through hole formed in the side edge of the tape knitted or woven by using the synthetic fiber thread. Therefore, the female and male engaging devices can be firmly fixed to the tape made of the synthetic fiber, and thus, the device can be used for a long time without anxiety.

According to an eleventh aspect of the invention, in addition to the effects of the invention stated in any one of the first to tenth aspects, the female engaging device and the male engaging device have leg portions with the same thickness, and have flat shapes as a whole. Therefore, because the female and male engaging devices do not project conspicuously from the surface, the device has a good appearance and is thin, and is best suitable for foundation wares. Thus, the effects of the invention are extremely remarkable.

What is claimed:

1. A female-male engaging device with tapes, comprising, a female engaging device having a leg portion mounted to a side edge of a tape at intervals faces a male engaging device mounted to a side edge of a tape at intervals, the female engaging device is defined with a leg portion for sandwiching the tape, a cavity portion vertically penetrating and extending through the female engaging device in front of the leg portion, and an engaging hole in a front wall at a front end of the cavity portion communicating with the cavity portion, and the male engaging device is defined with a leg portion for sandwiching the tape, and a bulging engaging head projecting from a front face of the leg portion to be fitted into the engaging hole and into the cavity and engaged behind the front wall of the cavity portion such that the female engaging device and the male engaging device can be pushed against each other in a plane direction for engaging and disengaging with each other.

2. A female-male engaging device with tapes according to claim 1, wherein a plurality of the female engaging devices are disposed at the side edge of one of a pair of the tapes at intervals and the male engaging devices are disposed at the side edge of the other of the tapes so as to face the female engaging devices.

3. A female-male engaging device with tapes according to claim 1, wherein the female engaging device and the male engaging device are alternately and successively disposed on the side edge of the tape at intervals such that the female engaging device faces the male engaging device.

4. A female-male engaging device with tapes according to claim 1, wherein the engaging hole defined in the front wall of the female engaging device is formed into a laterally long rectangle, the center of the bulging engaging head of the male engaging device is arc-shaped in a plan view and is ellipse-shaped in a front view, a thickness of the center portion of the engaging head is larger than a thickness of the engaging hole, a thickness of each of opposite ends of the engaging head is smaller than the thickness of the engaging hole, and a thin neck portion is formed between the leg portion of the male engaging device and the engaging head.

5. A female-male engaging device with tapes according to claim 1, wherein the engaging hole defined in the front wall of the female engaging device is formed into a laterally long rectangle, a recessed groove into which a front end of the engaging head can be fitted is defined in an inner wall of the front face of the leg portion, the center of the bulging engaging head of the male engaging device is an arc-shaped in a plan view and is ellipse-shaped in a front view a thickness of the center portion of the engaging head is larger than a thickness of the engaging hole, a thickness of each of opposite ends of the engaging head is smaller than the thickness of the engaging hole, and a thin neck portion is formed between the leg portion of the male engaging device and the engaging head.

6. A female-male engaging device according to claim 1, wherein the engaging hole defined in the front wall of the female engaging device is formed into a laterally long rectangle, a recessed groove into which a front end of the engaging head can be fitted is defined in an inner wall of the front face of the leg portion, the bulging engaging head of the male engaging device has a front end edge portion substantially in a shape of a straight line and an ellipse-shaped in a front view, a thickness of a center portion of the engaging head is larger than a thickness of the engaging hole, a thickness of each of opposite ends of the engaging head is smaller than the thickness of the engaging hole, and a thin neck portion is formed between the leg portion of the male engaging device and the engaging head.

7. A female-male engaging device with tapes according to claim 1, wherein the female engaging device and the male engaging device are each made of thermoplastic resin, and each integrally molded at constant intervals by sandwiching a bulging core portion formed at the side edge of the tape knitted or woven by a synthetic fiber thread.

8. A female-male engaging device with tapes according to claim 1, wherein the female engaging device and the male engaging device are each made of thermoplastic resin, and each integrally molded through a through hole formed at constant intervals at the side edge of the tape knitted or woven by a synthetic fiber thread.

9. A female-male engaging device with tapes according to claim 1, wherein the female engaging device and the male engaging device have leg portions with the same thickness, and have flat shapes as a whole.

10. A female-male engaging device with tapes comprising a female engaging device mounted to a side edge of a tape at intervals faces a male engaging device mounted to a side edge of a tape at intervals, the female engaging device is defined with a leg portion for sandwiching the tape, two spaced tongue portions disposed at upper and lower portions of a front face of the leg portion, a cavity portion extending vertically through center portions of the tongue portions, and engaging portions forming the periphery of the cavity at front ends of the tongue portions, and the male engaging device having a leg portion for sandwiching the tape, and a bulging engaging head projecting from a front face of the leg portion for engagement with the engaging portions, such that the female engaging device and the male engaging device can be pushed against each other in a plane direction for engaging and disengaging with each other.

11. A female-male engaging device with tapes according to claim 10, wherein a plurality of the female engaging devices are disposed at the side edge of one of a pair of the tapes at intervals and the male engaging devices are disposed at the side edge of the other of the tapes so as to face the female engaging devices.

12. A female-male engaging device with tapes according to claim 10, wherein the female engaging device and the male engaging device are alternately and successively disposed on the side edge of the tape at intervals such that the female engaging device faces the male engaging device.

13. A female-male engaging device with tapes according to claim 10, wherein the tongue portions projecting from the front face of the leg portion of the female engaging device have thick base portions, the cavity portion has a square shape, a thin neck portion is formed between the engaging head and the leg portion of the male engaging device, the engaging head is set perpendicular to the neck portion, a thickness of a center portion of the engaging head is larger than a vertical gap between the engaging portions and a thickness of each of opposite ends of the engaging head is smaller than the gap between the engaging portions.

14. A female-male engaging device with tapes according to claim 10, wherein the female engaging device and the male engaging device are each made of thermoplastic resin, and each integrally molded at constant intervals by sandwiching a bulging core portion formed at the side edge of the tape knitted or woven by a synthetic fiber thread.

15. A female-male engaging device with tapes according to claim 10, wherein the female engaging device and the male engaging device are each made of thermoplastic resin, and each integrally molded through a through hole formed at constant intervals at the side edge of the tape knitted or woven by a synthetic fiber thread.

16. A female-male engaging device with tapes according to claim 10, wherein the female engaging device and the male engaging device have leg portions with the same thickness, and have flat shapes as a whole.

* * * * *